United States Patent [19]

Martin

[11] 4,176,017

[45] Nov. 27, 1979

[54] BRIGHTENING COMPOSITION FOR ACID ZINC ELECTROPLATING BATH AND PROCESS

[75] Inventor: Sylvia Martin, Detroit, Mich.

[73] Assignee: Oxy Metal Industries Corporation, Warren, Mich.

[21] Appl. No.: 7,740

[22] Filed: Jan. 31, 1979

[51] Int. Cl.[2] ..... C25D 3/22

[52] U.S. Cl. ..... 204/55 R

[58] Field of Search ..... 204/55 R, 55 Y, DIG. 2

[56] References Cited

U.S. PATENT DOCUMENTS

| | | | |
|---|---|---|---|
| 3,558,448 | 1/1971 | Accaries et al. | 204/55 R |
| 3,723,262 | 3/1973 | Rushmere | 204/55 R |
| 4,093,523 | 6/1978 | Henricks et al. | 204/55 R |

*Primary Examiner*—T. M. Tufariello

*Attorney, Agent, or Firm*—Richard P. Mueller; Arthur E. Kleugel

[57] ABSTRACT

An acid zinc electroplating bath and bright zinc plating process employing said bath which contains an effective amount of a controlled mixture of brightening agents including a bath soluble polyacrylamide polymer and N-substituted polyacrylamide derivatives thereof as well as copolymers thereof as a primary brightener in combination with a secondary brightener comprising boric acid and Group I and II metal salts thereof and/or thiourea and N-substituted derivatives thereof as well as selected adducts thereof. The acid zinc electroplating bath incorporating the mixture of primary and secondary brightening agents is economical and versatile in use and produces a ductile plating deposit having a lustrous appearance.

9 Claims, No Drawings

BRIGHTENING COMPOSITION FOR ACID ZINC ELECTROPLATING BATH AND PROCESS

BACKGROUND OF THE INVENTION

The acid zinc electroplating bath and process of the present invention is particularly applicable but not necessarily limited to so-called high speed zinc electroplating operations over a wide current density range such as encountered in strip plating, wire plating, rod plating, or the like. Electro-deposited zinc of a semi-bright to a lustrous appearance is desirable in such instances to provide a decorative plating while simultaneously imparting corrosion protection to the article.

Acid-type zinc electroplating baths heretofore known have incorporated brightening agents or combinations thereof which have not provided adequate versatility in their use over a broad range of current densities and have been deficient in providing the requisite semi-bright or lustrous zinc deposit under high speed electroplating conditions. Such prior art plating baths have also been expensive to use and require careful control.

Many of the problems and disadvantages associated with prior art acid zinc electroplating baths are overcome in accordance with the present invention by employing a controlled effective amount of a mixture of primary and secondary brightening agents which are effective to produce a semi-bright to lustrous zinc deposit over a broad range of current densities and which composition is particularly applicable for high speed electroplating processes.

SUMMARY OF THE INVENTION

The benefits and advantages of the present invention are achieved by an acid zinc electroplating bath and process employing said bath which can operate at a pH ranging from 0 up to about 6.5, and preferably at a pH of from about 3 to about 5.5. The acid zinc bath incorporates the zinc ion in conventional amounts preferably ranging from about 15 grams per liter (g/l) up to about 110 g/l and is introduced by an aqueous soluble zinc salt such as zinc sulfate, zinc chloride, zinc fluoroborate, zinc acetate or the like with pH adjustment being effected employing a corresponding acid. The bath may further contain conventional inert salts for increasing the conductivity of the bath as well as conventional additional additives to improve the zinc deposit obtained.

In addition to the foregoing, the bath further contains as essential constituents, a mixture of a primary and a secondary brightening agent in effective amounts to produce a semi-bright to lustrous zinc deposit wherein the primary brightener can be employed at concentrations of 0.001 g/l up to its solubility limit while the secondary brighteners can be employed in controlled amounts to further enhance the brightness of the zinc deposit obtained. The primary brightener comprises a polymer of acrylamide of N-substituted acrylamides as well as copolymers of the foregoing and a solubilizing agent selected from the group consisting of methacrylic acid, acrylic acid, acrylonitrile, methacrylonitrile, vinyl $C_1$–$C_5$ alkyl esters, vinyl halide, epihalohydrin, vinylidine halide, alkylene oxide and mixtures thereof. The general polymer is of the formula:

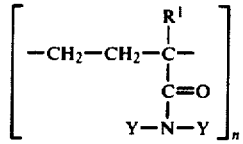

wherein:

Y may be the same or different and is R or RX, where R is H or $C_{1-10}$ aliphatic radical, where X is H, OH, $COOR^1$, $COON[R^1]_2$, $SO_3M$, CN, $N[R^1]_2$ or $OR^1$, where M is H or a Group I or II metal; $R^1$ is H or $C_{1-2}$ alkyl radical; and n is 2 to 2,000,000.

The secondary brightener or mixtures of secondary brighteners is selected from the group consisting of boric acid and Group I and II metal salts thereof; and/or thiourea and N-substituted derivatives thereof of the formula:

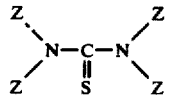

wherein:

Z may be the same or different and is $R^2$ or $R^2X^1$; where $R^2$ is H, $C_{1-8}$ aliphatic radical, $C_{6-10}$ aryl radical, $C_{5-9}$ heterocyclic nitrogen radical; where $X^1$ is H, OH, $COOR^3$, $COON[R^3]_2$, $SO_3M^1$, CN, $N[R^3]_2$, $OR^3$, or $PO_4M^1$; where $R^3$ is H or $C_{1-2}$ alkyl radical and $M^1$ is H or a Group I or II metal, and where Z on one N can form a cyclic with Z on other N.

The thiourea and N-substituted derivatives thereof can be further modified by forming sulfur adducts with propane sultone, haloacetic acid, halosulfonic acid as well as mixtures thereof.

The boric acid secondary brightener or metal salts thereof can be employed in concentrations up to 80 g/l with amounts ranging from 7 to 40 g/l being preferred. The thiourea or N-substituted derivatives thereof secondary brightener can be employed in amounts up to 10 g/l with amounts of about 0.01 to 5 g/l being preferred. When a mixture of the two secondary brighteners are employed, the boric acid secondary brightener can be employed in amounts of at least 3 g/l up to 80 g/l while the thiourea secondary brightener can be employed in amounts of at least 0.005 g/l up to 10 g/l.

In accordance with the process aspects of the present invention, the foregoing acid zinc electroplating bath incorporating the mixture of brightening agents is operated at a pH ranging from 0 up to about 6.5 and at a temperature of 50° up to 180° F. Current densities of from 10 up to 500 ASF can be employed including still higher current densities when special high speed plating techniques are utilized.

Additional benefits and advantages of the present invention will become apparent upon a reading of the description of the preferred embodiments taken in conjunction with the specific examples provided.

DESCRIPTION OF THE PREFERRED EMBODIMENTS

The improved bright acid zinc electroplating bath of the present invention comprises an aqueous solution containing a hydrogen ion concentration sufficient to provide an operating pH of from about 0 up to about 6.5. In addition to the controlled amount of primary and secondary brightening agents employed, the bath further incorporates appropriate concentrations of other conventional constituents utilized in acid zinc electroplating baths including zinc salts, conductivity salts, as well as supplemental brightener constituents of the types heretofore known to further enhance the brightness of the zinc plating deposits obtained. The zinc ion, in accordance with conventional practice, is introduced into the aqueous solution in the form of an aqueous soluble zinc salt, such as zinc sulfate, zinc chloride, zinc fluoroborate, zinc acetate or the like, in addition to mixtures thereof to provide an operating zinc ion concentration ranging from about 15 g/l to about 110 g/l with concentrations of about 20 g/l up to 80 g/l being preferred. The acidity of the bath is adjusted by employing a corresponding acid depending upon the zinc salt used including sulfuric acid, hydrochloric acid, fluoroboric acid, acetic acid, or the like, to provide an operating pH of about 0 up to about 6.5 and preferably a pH ranging from about 3 up to about 5.5.

Conventionally, various inert salts or mixtures thereof are employed to further increase the conductivity of the bath and can include sodium chloride, potassium chloride, ammonium chloride, sodium sulfate, potassium sulfate, magnesium chloride, magnesium sulfate, or the like, which are utilized in amounts conventionally ranging from about 10 up to about 200 g/l.

In addition to the foregoing conventional acid zinc electroplating bath constituents, the bath further includes as an essential ingredient, a controlled effective amount of a mixture of a primary polymeric brightening agent and a secondary or mixture of secondary brightening agents which provide unexpected benefits in the zinc deposit formed as well as in providing increased versatility in the use of the electroplating bath.

The primary brightening agent comprises a polymer selected from the group consisting of polyacrylamide polymers and N-substituted polyacrylamide derivatives and copolymers thereof of the formula:

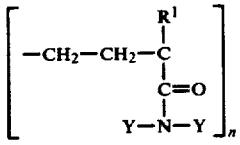

wherein:

Y may be the same or different and is R or RX, where R is H or $C_{1-10}$ aliphatic radical, where X is H, OH, $COOR^1$, $COON[R^1]_2$, $SO_3M$, $CN,N[R^1]_2$ or $OR^1$, where M is H or a Group I or II metal; $R^1$ is H or $C_{1-2}$ alkyl radical; and n is 2 to 2,000,000 and copolymers of said polymer and a solubilizing agent present in an amount up to 25 mole percent of the copolymer selected from the group consisting of methacrylic acid, acrylic acid, acrylonitrile, methacrylontrile, vinyl $C_{1-5}$alkyl esters, vinyl halide, epihalohydrin, vinylidine halide. alkylene oxide and mixtures thereof.

The copolymerization of acrylamide or N-substituted acrylamide derivatives with the solubilizing agent provides for improved water solubility of the polymer and is desirable particularly when high molecular weight polymers are employed. The mole percent of the solubilizing agent in the resultant copolymer is controlled at an amount of less than about 25 mole percent to retain the beneficial character of the acrylamide constituent in providing improved brightening of the zinc deposit.

The concentration of the primary polymeric brightening agent may range from as low as about 0.001 g/l up to levels approaching the solubility limit of the polymer in the aqueous bath. At concentrations below about 0.001 g/l optimum benefits of the polymeric primary brightener ordinarily cannot be obtained while concentrations usually above about 10 g/l results in the bath becoming undesirably viscous. In addition, the use of excessive amounts of the primary brightening agent is generally uneconomical in as much as no appreciable benefits are obtained over that obtained with moderate concentrations. Generally, the primary polymeric brightening agent is employed within a range of about 0.1 to about 5 g/l. The particular amount employed will vary depending upon the other constituents present in the bath including the quantity and type of secondary brighteners and supplemental brighteners employed, the molecular weight of the specific polymer employed and the specific bath operating conditions. Generally, the higher the molecular weight of the polymer employed, the less quantity of polymer necessary.

In addition to the primary polymeric brightening agent, the bath further includes a secondary brightener which may either comprise boric acid or metal salts thereof or thiourea and N-substituted derivatives thereof as well as mixtures of these two secondary constituents. Boric acid or metal salts of boric acid comprised of the Group I and II metals have been found to provide a synergistic effect in combination with the polymeric primary brightener on the brightness of the zinc deposit obtained. The boric acid or boric acid salt can be employed in amounts up to about 80 g/l while amounts ranging from about 7 up to about 40 g/l are preferred when the boric acid or boric acid salt is employed in the absence of the thiourea secondary brightening agent. When the bath further contains a combination of both secondary brighteners, the boric acid or borate salt is employed in an amount of at least about 3 g/l up to about 80 g/l.

The thiourea base secondary brightening agent comprises thiourea and N-substituted derivatives thereof of the formula:

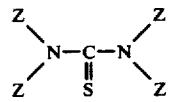

wherein:

Z may be the same or different and is $R^2$ or $R^2X^1$; where $R^2$ is H, $C_{1-8}$ aliphatic radical, $C_{6-10}$ aryl radical, $C_{5-9}$ heterocyclic nitrogen radical; where $X^1$ is H, OH, $COOR^3$, $COON[R^3]_2$, $SO_3M^1$, CN, $N[R^3]_2$, $OR^3$, or $PO_4M^1$; where $R^3$ is H or $C_{1-2}$ alkyl radical and $M^1$ is H or a Group I or II metal, and where Z on one N can form a cyclic with Z on other N; and further including the sulfur adducts of said thiourea and N-substituted derivatives thereof selected from the group consisting of propane sultone, haloacetic acid, halosulfonic acid, and mixtures thereof.

Typical of thiourea materials which can be satisfactorily employed in accordance with the foregoing definition are thiourea; N-allythiourea; N-phenylthiourea; N-acetylthiourea; N,N'-ethylenethiourea; N-orthotolylthiourea; N-pyridylthiourea; N-methylthiourea; thiocarbanilide; N,N-dimethyl-N'-phenylthiourea; N-pyridyl-N-benzoylthiourea propane sultone; N,N,N,'N'-tetramethylthiourea; N-phenyl-N'-carboxymethylthiourea; N-phenyl-N'-carboxypentylthiourea; N-phenyl-N'-4-carboxyphenylthiourea; N-phenyl-N'-3-carboxyphenylthiourea; N-phenyl-N'-3,4-dicarboxyphenylthiourea; N-butyl-N'-4-carboxyphenylthiourea; N-octyl-N'-3,4-dicarboxyphenylthiourea; N-butyl-N'-carboxymethylthiourea; N-α-napthyl-N'-carbosymethylthiourea; and the like. Of the aforementioned typical thiourea materials, N,N'-ethylenethiourea is of a cyclical structure in which a methylene group on one nitrogen is connected to a methylene group on the adjacent nitrogen through a cross-link forming a cyclical compound having a structural formula:

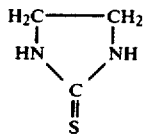

The thiourea base secondary brightener can be employed in amounts up to about 10 g/l and preferably within a range of about 0.01 up to about 5 g/l when employed in combination with the primary polymeric brightening agent in the absence of the boric acid base secondary brightener. When the boric acid base secondary brightener is also present, the thiourea base secondary brightener can be employed in an amount as low as about 0.005 g/l up to about 10 g/l in combination with from about 3 g/l to 80 g/l of the boric acid secondary brightener.

In addition to the primary and secondary brightening agents, it is also contemplated that the acid zinc electroplating bath can further incorporate controlled amounts of other bath compatible brightening agents of the types conventionally employed in acid zinc plating solutions. Included among such supplemental and optional brightening agents are aromatic aldehydes or ketones, nicotinate quaternaries, polyepichlorohydrin quaternaries with amines, polyethyleneimines and their quaternaries, or the like.

In accordance with the process aspects of the present invention, the attainment of semi-bright to lustrous zinc plating deposits on metal substrates is achieved by employing any one of a known variety of plating techniques. The bath is particularly applicable for high speed plating of ferrous articles such as wire, strip, tubing, or the like. In operation, the electroplating bath incorporating the constituents as heretofore described is controlled within an operating pH range of about 0 up to about 6.5 and at a temperature of from about 50° up to about 180° F. Zinc plating can be carried out at current densities generally ranging from as low as about 10 amperes per square foot (ASF) up to 500 ASF and higher depending upon the specific plating technique employed.

In order to further illustrate the improved acid zinc plating bath of the present invention, the following specific examples are provided. It will be appreciated that the examples provided are for illustrative purposes and are not intended to be restricture of the present invention as herein described and as set forth in the subjoined claims.

EXAMPLE I

A steel test panel is plated in an air agitated bath for a period of ten minutes at a current density of 50 ASF. The zinc plating bath is at a pH of 4.7 and a temperature of 75° F. The bath is of the following composition:

| Constituent | Concentration |
|---|---|
| zinc sulfate | 175 g/l |
| polyacrylamide (MW 50,000) | 0.25 g/l |
| phenyl thiourea | 0.25 g/l |

The appearance of the plated test panel is fully bright in the high current density areas with a light gray deposit in the low current density areas.

EXAMPLE 2

A steel test panel is plated for a period of ten minutes at a current density of 45 ASF. Agitation of the bath is provided by cathode rod agitation. The plating bath is at a temperature of 70° F. and at a pH of 4.2 having the following composition:

| Constituent | Concentration |
|---|---|
| zinc sulfate | 150 g/l |
| ammonium sulfate | 20 g/l |
| polyacrylamide (MW 15,000) | 1 g/l |
| thiourea | 0.3 g/l |

The appearance of the plated test panel is similar to that obtained in Example 1.

EXAMPLE 3

A steel test panel is plated for a period of fifteen minutes at a current density of 80 ASF in a plating bath employing air agitation. The bath is at a pH of 3.9 and a temperature of 78° F. having the following composition:

| Constituent | Concentration |
|---|---|
| zinc fluoroborate | 200 g/l |
| poly N(2-hydroxy ethyl) acrylamide (MW 20,000) | 0.2 g/l |
| allyl thiourea | 0.15 g/l |

The appearance of the plated test panel is similar to that obtained in Examples 1 and 2 except the low current density bright range is larger.

EXAMPLE 4

A steel test panel is plated in a bath employing air agitation for a period of ten minutes at 35 ASF. The bath is at a temperature of 75° F. and at a pH of 5.0 having the following composition:

| Constituent | Concentration |
|---|---|
| zinc chloride | 110 g/l |
| ammonium chloride | 160 g/l |
| polyacrylamide (MW 600) | 0.25 g/l |
| N-hydroxy ethyl thiourea | 0.05 g/l |

The appearance of the plated test panel is bright to semi-bright over the entire current density range.

EXAMPLE 5

A steel test panel is plated in a bath employing air agitation for a period of five minutes at 100 ASF. The bath is at a pH of 4.5 and a temperature of 76° F. having the following composition:

| Constituent | Concentration |
|---|---|
| zinc sulfate | 205 g/l |
| boric acid | 23 g/l |
| poly 2-acrylamide-2-methyl propane sulfonic acid (MW 50,000) | 2 g/l |
| thiourea N-propane sulfonic acid | 1 g/l |

The appearance of the plated test panel is bright in the high current density areas with a small light gray deposit in the very low current density areas.

EXAMPLE 6

A steel test panel is plated in a bath employing air agitation for a period of fifteen minutes at 40 ASF. The bath is at a pH of 5.0 and a temperature of 72° F. having the following composition:

| Constituent | Concentration |
|---|---|
| zinc chloride | 80 g/l |
| potassium chloride | 225 g/l |
| polyacrylamide (MW 1,000) | 0.7 g/l |
| boric acid | 27 g/l |
| phenyl thiourea | 0.02 g/l |

The appearance of the plated test panel is bright to semi-bright over the entire current density range.

EXAMPLE 7

A steel test panel is plated in a bath having air agitation for a period of ten minutes at 50 ASF. The bath is of a pH of 4.6 and a temperature of 77° F. having the following composition:

| Constituent | Concentration |
|---|---|
| zinc sulfate | 175 g/l |
| boric acid | 23 g/l |
| poly 2-acrylamide 2-methyl propane sulfonic acid | 2 g/l |

The appearance of the plated test panel is semi-bright over the entire current density range except in the very low current density areas where a slightly dull appearance prevailed.

EXAMPLE 8

A steel test panel was plated in a bath provided with air agitation for a period of eight minutes at 300 ASF. The bath is at a pH of 4.5 and a temperature of 75° F. having the following composition:

| Constituent | Concentration |
|---|---|
| zinc sulfate | 200 g/l |
| boric acid | 23 g/l |
| ammonium chloride | 15 g/l |
| polyacrylamide (MW 1,000,000) | 0.05 g/l |
| allyl thiourea | 0.15 g/l |

The appearance of the plated test panel is bright over its entire area.

What is claimed is:

1. An aqueous zinc electroplating bath having a pH of about 0 up to about 6.5 containing an effective amount of a mixture of (a) a primary brightener comprising a polymer selected from the group consisting of polyacrylamide polymers and N-substituted polyacrylamide derivatives and copolymers thereof of the formula:

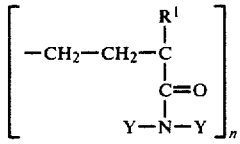

wherein:

Y may be the same or different and is R or RX, where R is H or $C_{1-10}$ aliphatic radical, where X is H, OH, $COOR^1$, $COON[R^1]_2$, $SO_3M$, CN, $N[R^1]_2$ or OR, where M is H or a Group I or II metal; $R^1$ is H or $C_{1-2}$ alkyl radical; and n is 2 to 2,000,000, and copolymers of said polymer and a solubilizing agent present in an amount up to 25 mole percent of the copolymer selected from the group consisting of methacrylic acid, acrylic acid, acrylonitrile, methacrylonitrile, vinyl $C_{1-5}$ alkyl esters, vinyl halide, eiphalohydrin, vinylidine halide, alkylene oxide and mixtures thereof; and (b) a secondary brightener and mixtures thereof selected from the group consisting of boric acid and Group I and II metal salts thereof; and/or thiourea and N-substituted derivatives thereof of the formula:

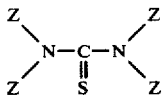

wherein:

Z may be the same or different and is $R^2$ or $R^2X^1$, where $R^2$ is H, $C_{1-8}$ aliphatic radical, $C_{6-10}$ aryl radical, $C_{5-9}$ heterocylic nitrogen radical; where $X^1$ is H, OH, $COOR^3$, $COON[R^3]_2$, $SO_3M^1$, CN, $N[R^3]_2$, $OR^3$, or $PO_4M^1$, where $R^3$ is H or $C_{1-2}$ alkyl radical and $M^1$ is H or a Group I or II metal, and where Z on one N can form a cyclic with Z on other N; and further including the sulfur adducts of said thiourea and N-substituted derivatives thereof selected from the group consisting of propane sultone, haloacetic acid, halosulfonic acid, and mixtures thereof.

2. The zinc electroplating bath as defined in claim 1 in which said primary brightener is present in an amount of about 0.001 g/l up to the solubility limit thereof in said aqueous zinc electroplating bath.

3. The zinc electroplating bath as defined in claim 1 in which said primary brightener is present in an amount of about 0.1 to about 5 g/l.

4. The zinc electroplating bath as defined in claim 1 in which said secondary boric acid and metal salt thereof secondary brightener is present in an amount up to about 80 g/l.

5. The zinc electroplating bath as defined in claim 1 in which said secondary boric acid and metal salt thereof secondary brightener is present in an amount of from about 7 up to 40 g/l.

6. The zinc electroplating bath as defined in claim 1 in which said thiourea and N-substituted derivative thereof secondary brightener is employed in an amount up to about 10 g/l.

7. The zinc electroplating bath as defined in claim 1 in which said thiourea and N-substituted derivative thereof secondary brightener is employed in an amount of about 0.01 to about 5 g/l.

8. The zinc electroplating bath as defined in claim 1 in which said boric acid and Group I and II metal salt thereof secondary brightener is employed in an amount of about 3 g/l up to 80 g/l in combination with from about 0.005 g/l up to 10 g/l of said thiourea and N-substituted derivatives thereof secondary brightener.

9. A process for depositing a bright zinc plating on a substrate which comprises the steps of electro-depositing zinc from an aqueous acid zinc electroplating bath of a composition as defined in any one of claims 1 through 8.

* * * * *